US006276321B1

(12) United States Patent
Lichti et al.

(10) Patent No.: US 6,276,321 B1
(45) Date of Patent: Aug. 21, 2001

(54) CAM PHASER HAVING A TORSIONAL BIAS SPRING TO OFFSET RETARDING FORCE OF CAMSHAFT FRICTION

(75) Inventors: Thomas Howard Lichti, Fairport; Michael James Fox, Stafford; Jason M Urckfitz, Brockport; Wayne Stanley Harris, Hilton, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/481,198

(22) Filed: Jan. 11, 2000

(51) Int. Cl.[7] ..... F01L 1/344

(52) U.S. Cl. ..... 123/90.17; 123/90.37; 123/90.65; 74/568 R; 464/2; 464/160

(58) Field of Search ..... 123/90.15, 90.17, 123/90.31, 90.37, 90.65; 74/568 R; 464/1, 2, 160

(56) References Cited

U.S. PATENT DOCUMENTS 5,836,277 * 11/1998 Kira et al. ..... 123/90.17
5,870,983 * 2/1999 Sato et al. ..... 123/90.17
6,035,819 * 3/2000 Nakayoshi et al. ..... 123/90.17
6,039,015 * 3/2000 Sato ..... 123/90.17
6,039,016 * 3/2000 Noguchi ..... 123/90.17

* cited by examiner

*Primary Examiner*—Wellun Lo
(74) *Attorney, Agent, or Firm*—John A. Vanophem

(57) ABSTRACT

A vane-type camshaft phaser wherein a coil spring under torsional compression or extension is disposed coaxially within an annular cavity formed in either the cover plate or back plate. A first end of the spring is connected to the cover plate or back plate, and a second end extends from the cavity and is connected to the phaser rotor. The spring constant is selected such that a biasing torque is exerted on the rotor in the valve-opening-advancing direction which counters the inherent valve-opening-retarding torque bias of the camshaft during operation. The bias spring permits more rapid response to a demand on the cam phaser for advancing valve timing, and is also useful in orienting the camshaft advantageously, especially an exhaust valve camshaft, in a timing-advanced position when the engine is shut off or operating at low engine speed.

6 Claims, 4 Drawing Sheets

CAM PHASER HAVING A TORSIONAL BIAS SPRING TO OFFSET RETARDING FORCE OF CAMSHAFT FRICTION

TECHNICAL FIELD

The present invention relates to cam phasers for altering the phase relationship between valve motion and piston motion in reciprocating internal combustion engines; more particularly, to cam phasers having a vaned, hydraulically-rotatable rotor disposed in an internally-lobed stator to form actuation chambers therebetween; and most particularly to a cam phaser wherein a torsion spring offsets the valve-opening-retarding frictional bias of the camshaft.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. The terms "cam phaser" and "camshaft phaser" may be used interchangeably herein. Typically, a cam phaser employs a first element driven in fixed relationship to the crankshaft and a second element adjacent to the first element and mounted to the end of the camshaft in either the engine head or block. A cam phaser is commonly disposed at the camshaft end opposite the engine flywheel, herein referred to as the "front" end of the engine. The first element is typically a cylindrical stator mounted onto a crankshaft-driven gear or pulley, the stator having a plurality of radially-disposed inwardly-extending spaced-apart lobes and an axial bore. The second element is a vaned rotor mounted to the end of the camshaft through the stator axial bore and having vanes disposed between the stator lobes to form actuation chambers therebetween such that limited relative rotational motion is possible between the stator and the rotor. Such a phaser is known in the art as a vane-type cam phaser.

The disposition of the rotor in the stator forms a first, or timing-advancing, array of chambers on first sides of the vanes and a second, or timing-retarding, array of chambers on the opposite sides of the vanes. The apparatus is provided with suitable porting so that hydraulic fluid, for example, engine oil under engine oil pump pressure, can be brought to bear controllably on opposite sides of the vanes in the advancing and retarding chambers. Control circuitry and valving, commonly a multiport spool valve, permit the programmable addition and subtraction of oil to the advance and retard chambers to cause a change in rotational phase between the stator and the rotor, in either the rotationally forward or backwards direction, and hence a change in timing between the pistons and the valves.

As an engine camshaft rotates, each eccentric cam lobe, in its tum, displaces a spring-loaded cam-following mechanism outwards from the axis of the camshaft to open its dedicated valve, then allows return motion of the mechanism to close the valve. Because of friction, more energy is expended in opening each valve than is recovered in closing each valve. Within a cam phaser, this energy imbalance is expressed as a torsional bias in the opening-retarding direction. That is, the operating equilibrium position of the rotor within the phaser appears biased in the retarding direction with reference to an anticipated position based solely on hydraulic considerations. This means that the hydraulic system driving the rotation of the rotor, in responding to a demand for advancing of the valve timing, must overcome not only the inertia of the system but also the retarding bias of the camshaft friction.

What is needed is a mechanical means in a vane-type cam phaser for offsetting or neutralizing the retarding frictional bias of the camshaft to permit compensated hydraulic operation of the phaser and, consequently, more rapid opening-advancing response of the phaser.

SUMMARY OF THE INVENTION

The present invention is directed to a vane-type camshaft phaser wherein a coil spring under torsional compression or extension is disposed coaxially within an annular cavity formed in either the cover plate or back plate, a first end of the spring being connected to the cover plate or back plate, and a second end extending from the cavity and being connected to the phaser rotor. The spring constant is selected such that a biasing torque is exerted on the rotor in the opening-advancing direction which counters the inherent opening-retarding torque bias of the camshaft during operation, thereby permitting more rapid response to a demand on the cam phaser for advancing valve timing.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

The benefits of the invention can be more fully appreciated by first examining a prior art camshaft phaser.

Figure 1:
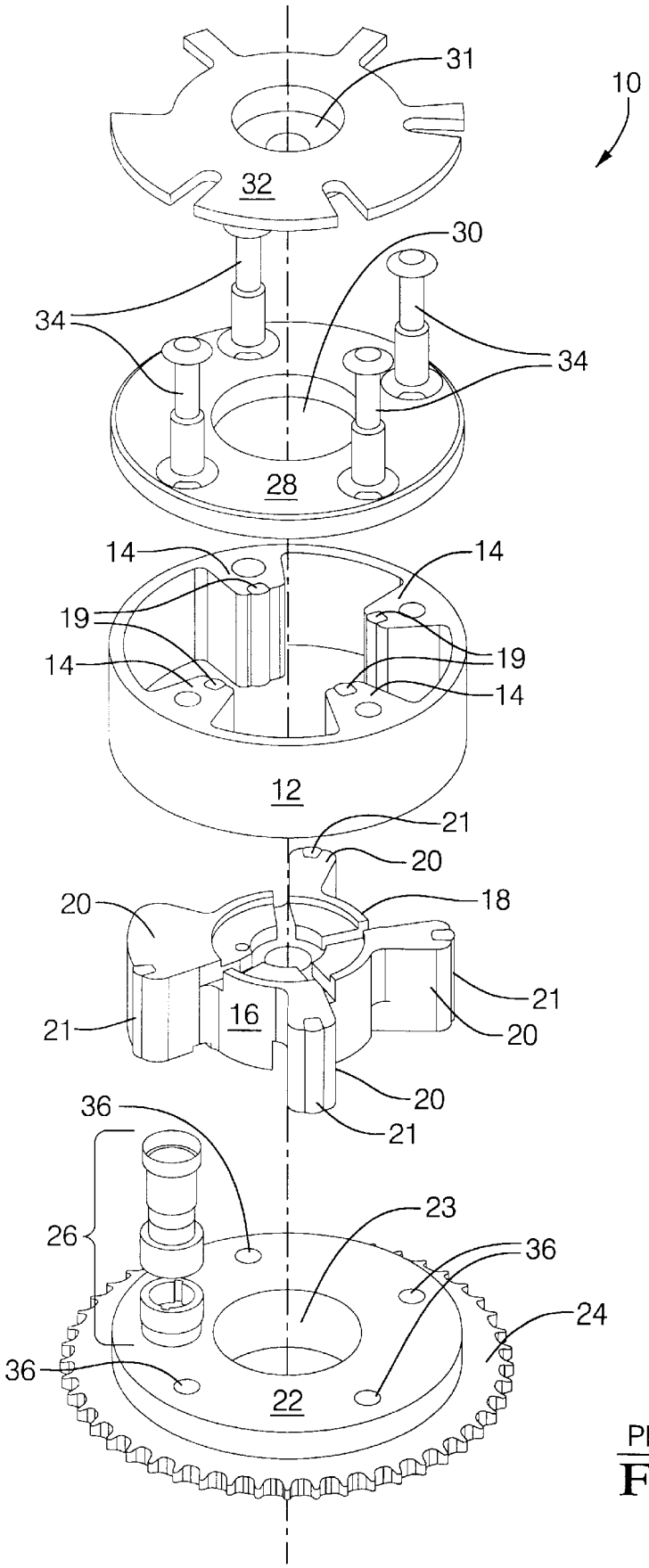
PRIOR ART FIG. 1
FIG. 1 is an exploded isometric view of a prior art camshaft phaser.
Figure 6:
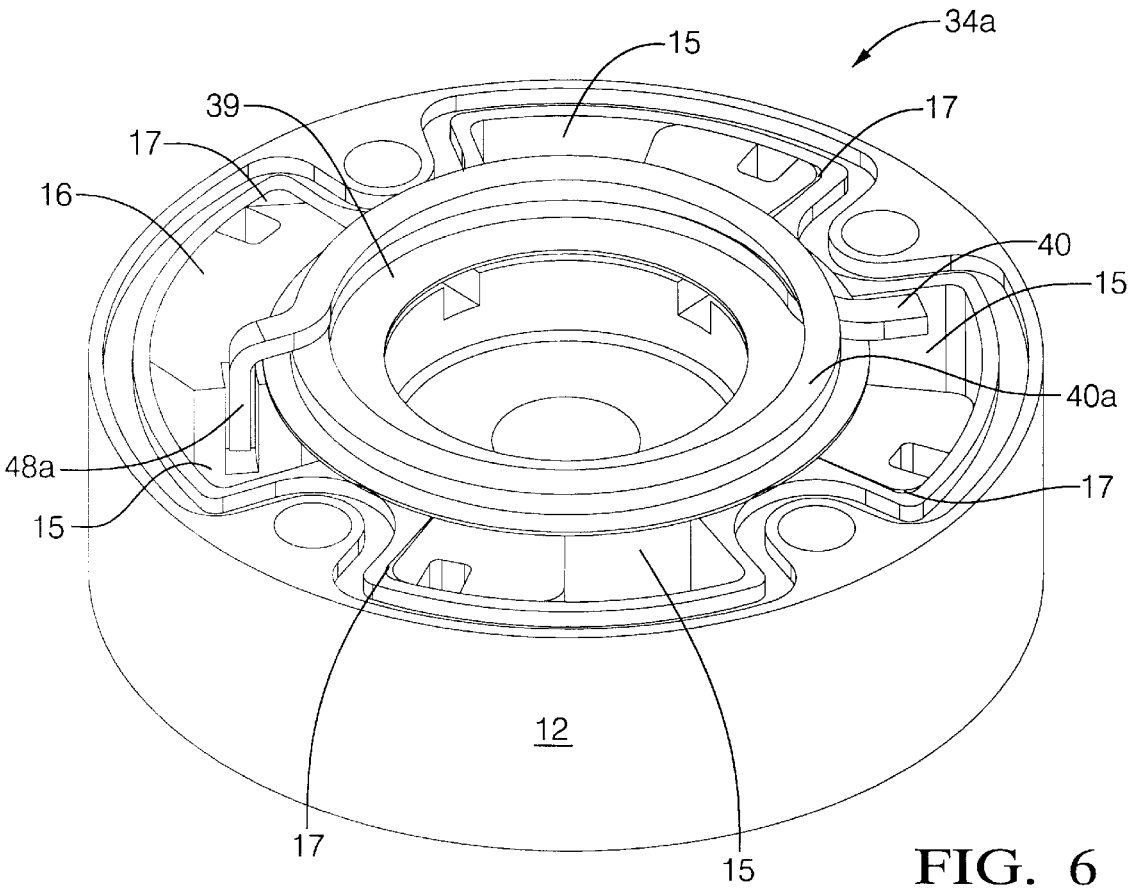
FIG. 6 is an isometric view of an assembled portion of the camshaft phaser shown in FIGS. 4 and 5.

Referring to FIG. 1, prior art vane-type cam phaser 10 includes a stator 12 having a plurality of inwardly-extending lobes 14, and a rotor 16 having a cylindrical hub 18 and a plurality of outwardly-extending vanes 20. A plurality of timing-advancing chambers and timing-retarding chambers (shown as 15 and 17, respectively, in the preferred embodiment shown in FIG. 6) are formed between the rotor vanes and the stator lobes when the rotor is assembled into the stator. Axially-extending lobe seals 19 and vane seals 21 prevent hydraulic leakage between the chambers. Back plate 22, which seals the back side of stator 12, rotor 16, and chambers 15,17, is attached to sprocket 24 for being rotationally driven, as by a timing chain or ribbed belt, from a crankshaft sprocket or gear in known fashion. Bore 23 in back plate 22 typically is receivable of the outer end of an engine camshaft (not shown) on which phaser 10 may be thus mounted in known fashion. An actuable lock 26 in a recess in a vane of rotor 16 may be extended at certain times in the cam phaser operation to engage a recess in back plate 22 for preventing relative rotation between the rotor and the back plate.

Figure 3:
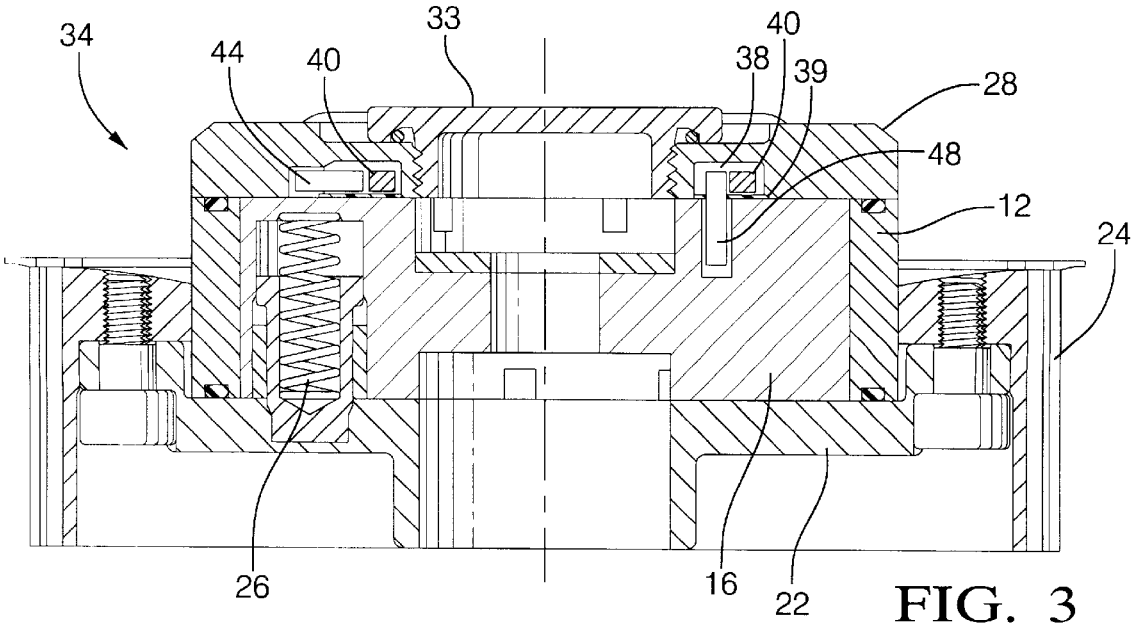
FIG. 3 is an axial cross-sectional view of the complete first embodiment of the camshaft phaser shown in FIG. 2.
Figure 5:
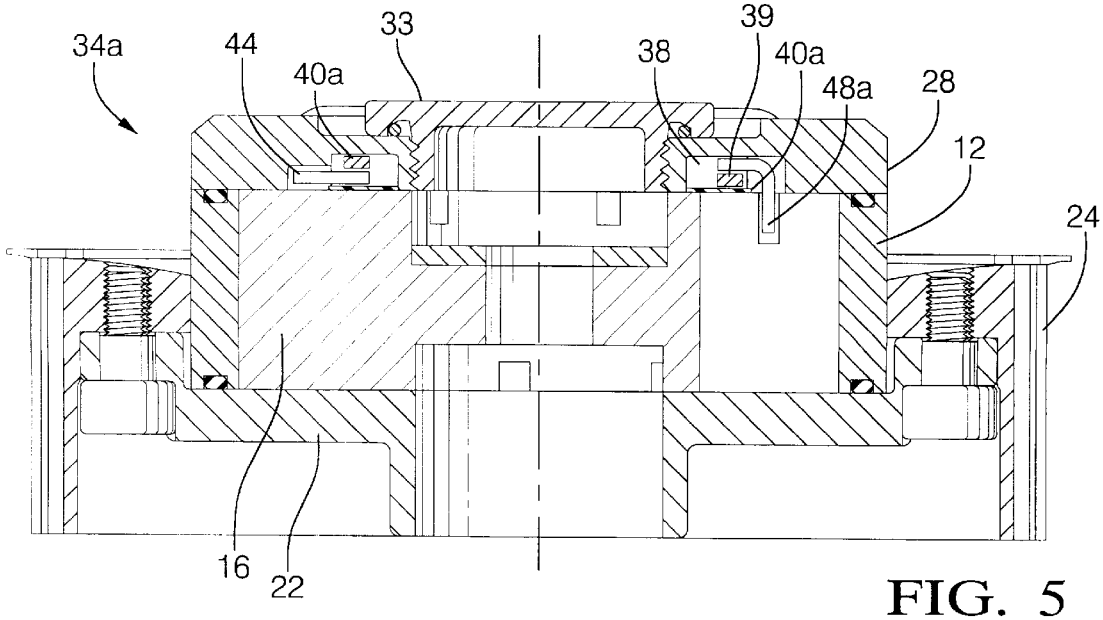
FIG. 5 is an axial cross-sectional view of the complete second embodiment of the camshaft phaser shown in FIG. 4.

Opposite back plate 22 is a cover plate 28 for sealing the front side of the phaser hydraulics analogously to back plate 22. Cover plate 28 has an axial bore 30 for receiving a formed central portion 31 of segmented target wheel 32, as shown in FIG. 1 or a threaded plug 33 as shown in FIGS. 3 and 5. Bolts 34 extend through cover plate 28 and stator 12 and are secured into threaded bores 36 in back plate 22. The assembled cover plate, stator, and back plate define a unitized housing wherein rotor 16 may rotate through an axial angle sufficient to advance or retard the opening of engine valves through a predetermined angular range, typically about 30°.

Figure 2:
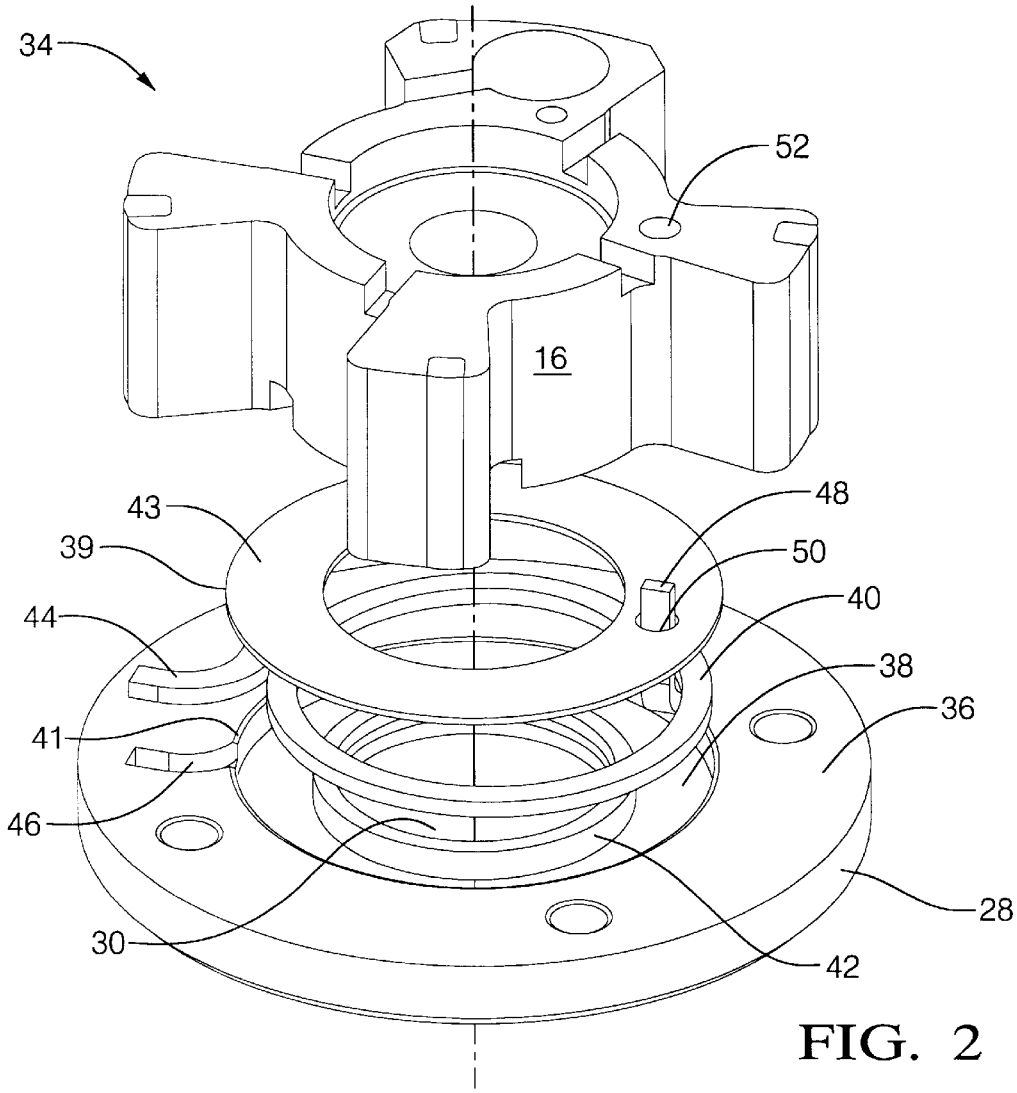
FIG. 2 is an exploded isometric view of a portion of a first embodiment of a camshaft phaser in accordance with the invention.

Referring to FIGS. 2 and 3, a first embodiment 34 of a camshaft phaser in accordance with the invention includes the above-listed parts. In addition, the inward-facing surface 36 of cover plate 28 is provided with an annular cavity 38 for receiving a first embodiment of a coil spring 40. Cavity 38 preferably is separated from bore 30 by a rim 42 which is a level extension of surface 36. Cavity 38 is closed by a ring-shaped spacer 39 which fits into an annular groove 41 such that the upper surface 43 of spacer 39 is flush with surface 36.

Spring 40 comprises preferably about 1½ turns and is provided at one end with an outwardly extending tang 44 which fits into a like-shaped recess 46 in surface 36 thereby rotationally anchoring spring 40 to cover plate 28 upon assembly of phaser 34. The opposite end of spring 40 is formed as a second tang 48 extending axially of phaser 34 radially inboard of the convolutions of spring 40 through a bore 50 in spacer 39 to engage a bore 52 in rotor 16, thereby rotationally anchoring spring 40 to rotor 16 upon assembly of phaser 34.

Preferably, the angular relationship between tangs 44 and 48 is such that when the phaser is assembled the valve timing is in the desired position, which may not necessarily be neutral timing. For example, for exhaust camshaft phaser applications, the desired default position ("engine-off position") may be timing-advanced. Lock mechanism 26 holds the phaser in the default position once the engine has stopped, but the rotationally-compressed or -extended bias spring helps to move the rotor to the advance position to enable the lock pin to slide into place. This can be especially beneficial at low engine speeds and high temperatures when the oil pressure may be very low.

Figure 4:
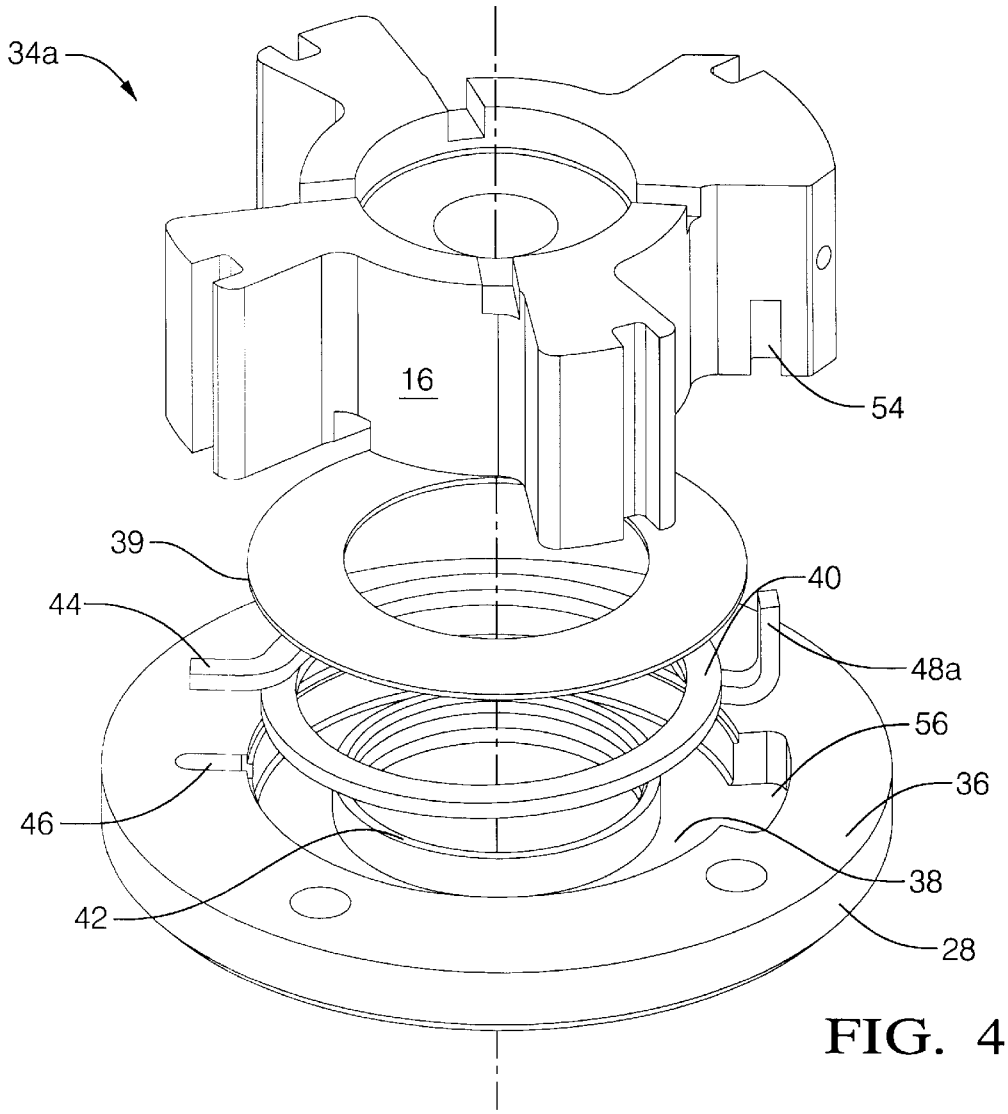
FIG. 4 is an exploded isometric view of a portion of a second embodiment of a camshaft phaser in accordance with the invention.
Figure 7:
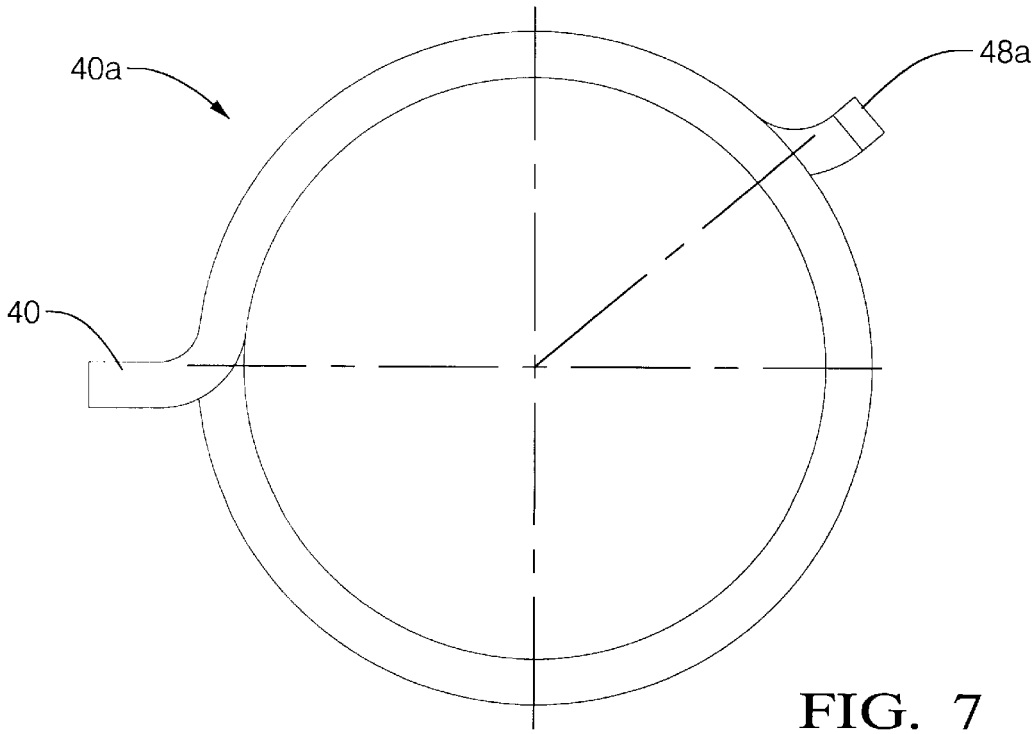
FIG. 7 is a plan view of the torsional bias spring shown in the phaser embodiments in FIGS. 4 through 6.

Because tang 48 extends through spacer 39, the spacer must be able to rotate in groove 41 with the spring and rotor as the rotor turns within the stator. A second and presently-preferred embodiment 34*a* of a camshaft phaser in accordance with the invention, shown in FIGS. 4,5, and 7, employs a modified spring 40*a*, shown in FIG. 6, having second tang 48*a* extending axially and radially outboard of the convolutions of spring 40*a* to engage a bore 52 or slot 54 in rotor 16. Cover plate 28 is provided with an additional recess 56 in communication with annular cavity 38 for receiving tang 48*a*. Recess 56 is circumferentially extensive sufficient to accommodate the range of rotational motion of tang 48*a* with rotation of the rotor. This embodiment permits an interference fit of spacer 39 into groove 41, thereby reducing potential intrachamber leakage of actuating oil along groove 41.

While the above-described embodiments in accordance with the invention dispose the bias spring within an annular cavity in the cover plate, it must be appreciated that the cavity and spring may alternatively be disposed instead and analogously within the back plate, within the scope of the invention.

The foregoing description of the invention, including a preferred embodiment thereof, has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A vane-type camshaft phaser, comprising: a) a unitized housing including a lobed stator having chambers therein, said housing being formed of back plate means, stator means, and cover plate means, wherein at least one of said cover plate means and said back plate means includes an annular cavity formed in a surface thereof and overlapping of said chambers, said annular cavity being closed by a circular spacer for preventing leakage from said chambers into said cavity; b) a vaned rotor disposed within said housing; and c) torque-biasing spring means disposed in said annular cavity and connected between said housing and said rotor for biasing said rotor to a non-neutral valve timing position.

2. A phaser in accordance with claim 1 wherein said spring means is a torsional coil spring.

3. A phaser in accordance with claim 2 wherein said coil spring is disposed in a rotationally-compressed state to provide said bias to said rotor.

4. A phaser in accordance with claim 2 wherein said coil spring is disposed in a rotationally-extended state to provide said bias to said rotor.

5. A phaser in accordance with claim 1 wherein said spring means extends through said spacer to engage said rotor.

6. A phaser in accordance with claim 1 wherein said spring means extends beside said spacer to engage said rotor.

* * * * *